US005337827A

United States Patent [19]

Hromas et al.

[11] Patent Number: 5,337,827

[45] Date of Patent: Aug. 16, 1994

[54] PRESSURE-CONTROLLED WELL TESTER ADAPTED TO BE SELECTIVELY RETAINED IN A PREDETERMINED OPERATING POSITION

[75] Inventors: Joe C. Hromas; Dinesh R. Patel, both of Sugar Land, Tex.

[73] Assignee: Schlumberger Technology Corporation, Houston, Tex.

[21] Appl. No.: 808,249

[22] Filed: Oct. 9, 1991

Related U.S. Application Data

[63] Continuation of Ser. No. 263,573, Oct. 27, 1988, abandoned.

[51] Int. Cl.[5] ..... E21B 34/10

[52] U.S. Cl. ..... 166/321; 166/240; 166/332

[58] Field of Search ..... 166/319, 321, 323, 332, 166/240

[56] References Cited

U.S. PATENT DOCUMENTS

| | | | |
|---|---|---|---|
| Re. 29,638 | 5/1978 | Nutter | 166/128 X |
| 4,113,012 | 9/1978 | Evans et al. | 166/321 X |
| 4,440,230 | 4/1984 | McGill | 166/321 |
| 4,509,604 | 4/1985 | Upchurch | 166/297 X |
| 4,557,333 | 12/1985 | Beck | 166/332 X |
| 4,576,234 | 3/1986 | Upchurch | 166/319 |
| 4,667,743 | 5/1987 | Ringgenberg et al. | 166/321 |
| 4,711,305 | 12/1987 | Ringgenberg | 166/321 X |
| 4,753,292 | 6/1988 | Ringgenberg et al. | 166/250 |
| 4,907,655 | 3/1990 | Hromas | 166/321 |

OTHER PUBLICATIONS

Pages for a publication entitled "DownHole Testing Services", Jan., 1987.

*Primary Examiner*—Hoang C. Dang

*Attorney, Agent, or Firm*—Henry N. Garrana; John H. Bouchard

[57] ABSTRACT

In the present invention a testing tool having an axial flow passage is arranged to be connected in a pipe string and placed in a well bore. Communication through the flow passage is controlled by a valve member which is cooperatively arranged in the body to be moved back and forth for selectively opening and closing communication through the flow passage. The testing tool further includes upper and lower mandrels that are selectively coupled together by a unique clutch mechanism that enables the valve member to be successively opened and closed as the well bore pressure is increased and decreased a predetermined number of times in a testing cycle. The clutch mechanism is thereafter operable for temporarily uncoupling the mandrels to enable the valve member to be retained in its open position as the well bore pressure is increased and decreased in a subsequent operating cycle of the test valve before resuming the testing operation.

28 Claims, 4 Drawing Sheets

FIG. 2D
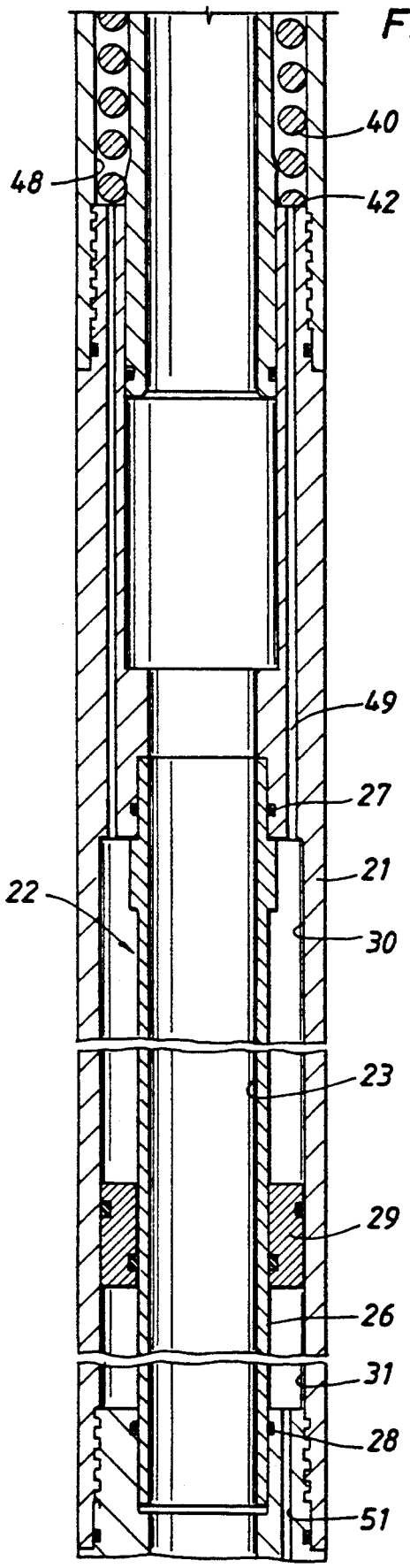
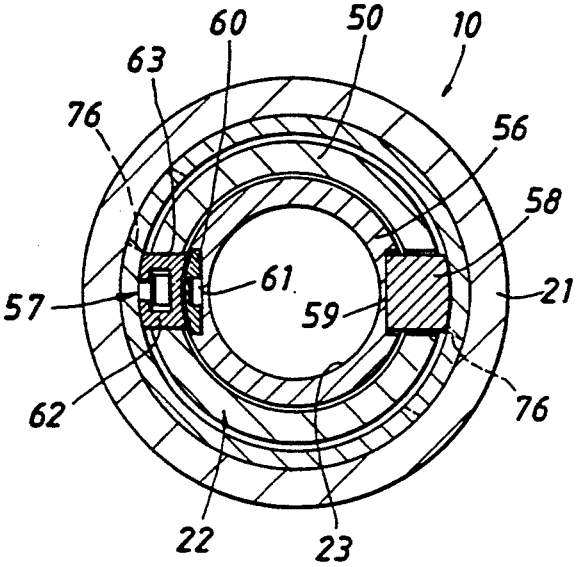
FIG. 3

PRESSURE-CONTROLLED WELL TESTER ADAPTED TO BE SELECTIVELY RETAINED IN A PREDETERMINED OPERATING POSITION

This is a continuation of application Ser. No. 07/263,573 filed Oct. 27, 1988, abandoned.

BACKGROUND OF THE INVENTION

This invention relates to full-bore drillstem testing apparatus; and, more particularly, this invention pertains to new and improved drillstem testing apparatus including a ball valve cooperatively arranged to be selectively opened and closed by successively varying the pressure of the well bore fluids for a predetermined number of operating cycles before the ball valve is subsequently moved to a selected operating position as required to carry out one or more completion operations.

BACKGROUND ART

It is customary to conduct so-called "drillstem tests" in cased well bores having one or more perforated intervals that provide fluid communication with earth formations penetrated by the well bore. One typical operating technique utilizes a full-bore packer that is positioned at a convenient depth location in the well bore and set for packing-off or isolating the formations which are to be tested from the completion fluids in the well bore. To conduct these drillstem tests, an assembly of tandemly-coupled full-bore tools is dependently suspended from a pipe string that is successively assembled and lowered into the cased well bore until a depending conduit or seal assembly arranged on the lower end of the tool string is inserted into a central seal bore in the packer and fluidly sealed therein. A normally-closed valve in the tool string is then selectively operated for opening fluid communication between the pipe string and the formations below the packer. In this manner, should the formations contain producible connate fluids, opening of the test valve will allow the fluids to flow to the surface by way of the tool string and the supporting pipe string. A series of pressure measurements are typically obtained by means of suitable pressure recorders included in the tool string. A sample-collecting tool is also typically included in the tool string whenever it is desired to collect one or more representative samples of the connate fluids produced during the testing operations.

Those skilled in the art recognize, of course, that many of the testing tools employed over the past few years have been controlled by selectively increasing the pressure of the well control fluids in the well bore above the packer to open the test valve and relieving the increased pressure when the valve is to be closed. Typical testing tools of this nature are described in the Nutter Reissue U.S. Pat. No. 29,638 and the McGill U.S. Pat. No. 4,440,230 which are respectively assigned to the assignee of the present application and are hereby incorporated by reference. As described in those patents, these testing tools are operated by a pressure-responsive valve actuator which has one pressure surface subjected to the pressure of the well bore fluids and an opposed pressure surface that is subjected to the pressure of a compressible fluid such as nitrogen that is isolated in a closed portion of an enclosed chamber by a floating annular piston. The tools respectively include inner and outer telescoping members arranged for controlling the communication between the well bore and the other portion of the enclosed chamber. These telescoping members are initially positioned so that the other portion of the enclosed chamber is in communication with the well bore fluids for maintaining the valve actuator balanced in relation to the hydrostatic pressure of the well bore fluids as the tool is being lowered into the well bore. Once the testing tool is positioned to conduct a test, the supporting pipe string is then slacked off to shift these inner and outer telescoped members to an alternate position for trapping well bore fluids in the other portion of the enclosed chamber so as to maintain the compressible gas at the hydrostatic pressure of the well fluids. Since the other side of the valve actuator is still communicated with the well bore fluids, the test valve can then be selectively opened and closed by successively increasing and relieving the pressure of the fluids in the well bore.

When either of the above-described testing tools are utilized with a full-bore production packer that has been set in the well bore above a formation interval of interest, typically a slip joint is coupled to the lower end of the supporting pipe string above one or more drill collars for imposing a substantial downward force on the tool string to prevent a seal assembly that carries a perforated tail pipe on its lower end from being forced upwardly out of the packer as treating fluids are injected into the isolated well bore interval. When a slip joint is included in any given tool string it is preferred to employ tools in that tool string that require few, if any, controlled manipulations of the pipe string from the surface. As a result, the tools in the tool string must, for the large part, be cooperatively arranged so that they can be independently operated by selectively raising the fluids in the well bore to different pressure levels to carry out the several stages of a typical testing operation.

It is, of course, difficult to reliably control several pressure-actuated tools in a given tool string if more than two or three distinctive pressure levels are required to selectively operate hose tools during the course of a typical drillstem test operation. The problem is even more acute whenever a particular pressure-actuated tool in the tool string needs to be selectively operated in only some stages of the testing sequence and to be selectively disabled or deactivated in other stages of the test sequence. One example of a pressure-actuated well tool capable of being selectively operated and deactivated is described in U.S. Pat. No. 4,907,655 to Hromas et al, filed Apr. 6, 1988, entitled "Pressure-Controlled Well Tester Operated by One or More Selected Actuating Pressures", which patent is assigned to the assignee of the present invention and is incorporated herein by reference. A new and improved bypass valve disclosed there is cooperatively arranged so that it is operated in only the initial stages of the operating sequence of that tool string and then it is permanently closed during the remaining stages of the operating sequence.

Those skilled in the art will particularly appreciate that the thrust of the aforementioned Nutter and McGill patents was directed to providing pressure-controlled full-bore testing valves that were cooperatively arranged to be repetitively opened and closed during the course of a typical testing operation by selectively controlling the pressure of the fluids in the well bore above the packer. The significant advantages provided by tools that can be controlled in this manner are abundantly clear. Nevertheless, it must be recognized that at times it is clearly advantageous to have the capability to temporarily retain the test valve in its open position so that it will not respond to a subsequent decrease in the well bore pressure. In that manner, the test valve can, for example, be left open following a testing operation so that one or more completion operations can then be conducted without having to maintain the pressure of the well bore fluids at an elevated level as is ordinarily necessary to keep the valve open. This capability has heretofore required tester valves with complex mechanisms such as the valve shown in U.S. Pat. No. 4,711,305.

OBJECTS OF THE INVENTION

Accordingly, it is an object of the present invention to provide new and improved drillstem testing valves which are adapted to be repetitively opened and closed as well as adapted to be temporarily retained in a predetermined operating position at the conclusion of a given operating cycle.

It is a further object of the invention to provide new and improved full-bore tester valves arranged to be cooperatively opened and closed for a selected number of operating cycles and then temporarily retained in a selected operating position before continuing with a second series of operating cycles.

It is yet another object of the present invention to provide a new and improved full-bore tester valve that is adapted to be repetitively opened and closed by successively increasing and reducing the pressure of the fluids in the well bore and then temporarily retained in its open position without manipulation of the supporting pipe string from the surface.

It is a further object of the invention to provide a new and improved full-bore testing tool including a pressure-responsive test valve that is cooperatively opened and closed for a predetermined number of changes of the pressure of the fluids in the well bore and then temporarily retained in its passage-open position independently of these pressure changes.

SUMMARY OF THE INVENTION

These and other objects of the present invention are attained by providing a testing tool arranged to be connected in a pipe string and having a body defining a flow passage. Tester valve means are cooperatively arranged in the body to selectively open and close fluid communication through the flow passage. The testing tool further includes means operable upon a predetermined number of operations of the tester valve to temporarily retain it in its open position before resuming the testing operation. In a preferred embodiment of the tester valve means of the invention, the tester valve means are cooperatively arranged to control the communication through the flow passage in response to selected increases and decreases of the pressure in the well bore. With that embodiment, the means for temporarily retaining the tester valve enables the tester valve to be left in its passage-open position while the pressure in the well bore is subsequently decreased at least once more.

BRIEF DESCRIPTION OF THE DRAWINGS

The several patentable features and distinctive aspects of the present invention are set forth with particularity in the appended claims. The arrangement and operation of the invention, together with further objects and various advantages thereof, may best be understood by way of the following written description of a preferred embodiment of apparatus incorporating the principles of the invention when taken in conjunction with the accompanying drawings, in which:

FIGS. 2A–2D are successive, elevational views which are partially cross-sectioned for showing a preferred embodiment of a new and improved full-bore tester valve incorporating the principles of the present invention;

FIG. 3 is a transverse cross-sectional view taken along the Line "3—3" in FIG. 4.

DESCRIPTION OF A PREFERRED EMBODIMENT

Figure 1:
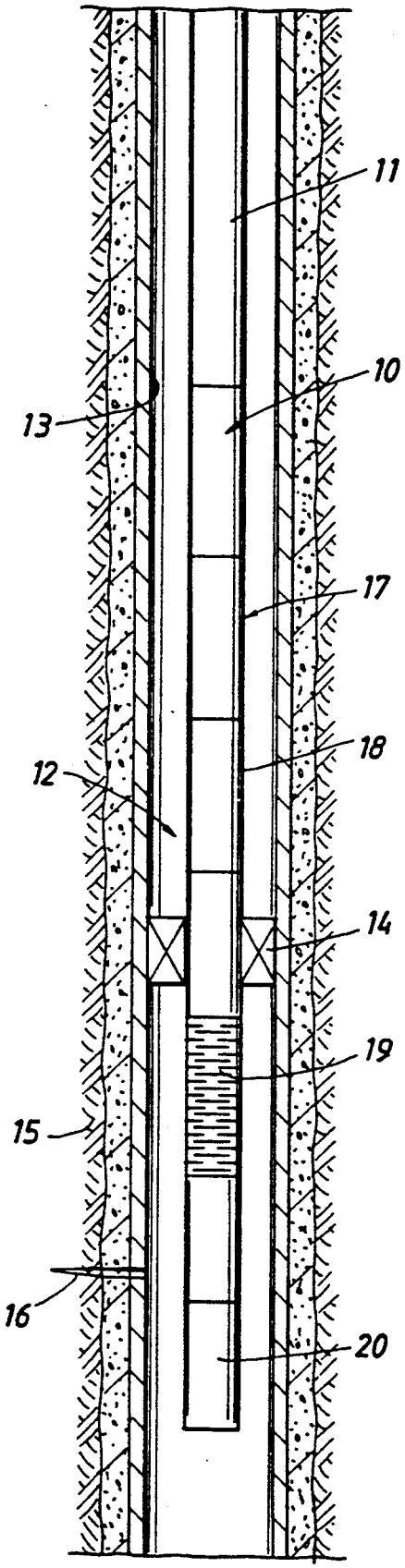
FIG. 1 shows a string of full-bore well tools such as may be typically used in a cased well bore and including a full-bore test valve of the present invention.

Turning now to FIG. 1, a tester valve 10 arranged in accordance with the principles of the present invention is shown dependently coupled to the lower end of a pipe string 11 as is typically assembled from a plurality of tandemly-coupled tubing joints. Although the tester valve 10 can be utilized in other manners, it is depicted in FIG. 1 as it might be utilized with other tools to provide a drillstem testing tool 12. Although the drillstem testing tool 12 can be successfully employed to conduct drillstem tests in an uncased borehole, the tool is depicted as it might be arranged to conduct one or more tests in a cased well bore as at 13. It will also be realized that although the tool 12 can be operated with equal success with a retrievable packer that is tandemly coupled to the lower end of the testing tool, FIG. 1 shows a production packer 14 that has been previously set at a convenient location in the well bore 13 for isolating one or more earth formations, as at 15, in communication with the isolated well bore interval by means of one or more perforations as at 16.

The new and improved tester valve 10 which is arranged in accordance with the principles of the present invention and, as will be subsequently described in more detail, is selectively operated from the surface in response to alternate increases and decreases in the pressure of the well bore fluids in the annulus of the well bore 13 above the packer 14. To illustrate one way in which the tester valve 10 may be operated, the testing tool 12 preferably includes a new and improved pressure reference tool 17 and a double-acting bypass valve 18 arranged in accordance with the aforementioned U.S. Pat. No. 4,907,655 to Hromas et. al. As illustrated, the pressure reference tool 17 and the bypass valve 18 are coupled in the tool string below the tester valve 10 of the present invention so as to facilitate the operation of the testing tool to conduct one or more drillstem tests in the well bore 13. A seal assembly or so-called "stinger", as shown at 19, that is appropriately sized to be slidably and sealingly inserted in the upstanding seal bore of the packer 14 is tandemly coupled in the string of tools at a convenient location below the bypass valve 18. It must be noted that although FIG. 1 illustrates the drillstem testing tool 12 as including the above-described pressure reference tool 17 and the bypass valve 18, the new and improved tester valve 10 of the present invention is not limited in any respect for being used either with or without either one or both of those tools.

To record the changes in pressure conditions in the well bore 13 during the course of a drillstem test, the testing tool 12 further includes one or more pressure recorders (not seen in the drawings) which are enclosed in a housing 20 arranged at a convenient location in the string of testing tools. It will, of course, depend upon the nature of any given testing operation and the condition of the well bore 13; but those skilled in the art will appreciate that one or more additional full-bore tools such as a sample collector, a jar and a safety joint (none of which are illustrated) may also be included in the tool string without affecting the operation of the drillstem testing tool 12. It will also be appreciated that, if necessary, a pressure-actuated perforating gun or so-called "tubing-conveyed perforator" (not seen in the drawings) such as the one described in U.S. Pat. No. 4,509,604 can be dependently coupled below the seal assembly 19 and appropriately arranged to be operated after the testing tool 12 has been positioned in the well bore 13.

Turning now to FIGS. 2A–2D, successive, partially cross-sectioned elevational views are shown of the new and improved tester valve 10 of the present invention which (as previously described by reference to FIG. 1) is arranged for operation in a cased well bore, as at 13, that was previously perforated to communicate one or more formations, as at 15, with the isolated interval of the well bore below the packer 14. To facilitate the description of the preferred embodiment of the tester valve 10, FIGS. 2A–2D have been moderately simplified by eliminating some of the minor constructional details of the tool but without affecting the full and complete disclosure of the present invention.

As seen generally at in FIGS. 2A–2D, the tester valve 10 of the present invention is comprised of a tubular outer body 21 and a tubular mandrel assembly 22 which is telescopically disposed in the outer body member and defines the upper portion of a full-bore axial passage 23 extending the full length of the tester valve. As shown generally at 24 in FIG. 2A, the upper end of the outer body 21 is counterbored and internally threaded as required for dependently coupling the tester valve 10 to other tools in the tool string thereabove. Similarly, the lower end of the tool body 21 is appropriately sized and provided with threads (not shown in the drawings) for coupling the tester valve 10 to other tools arranged in the tool string therebelow such as, for example, the pressure reference tool 17 (shown only in FIG. 1). A tubular member 26 is coaxially arranged in the lower portion of the outer body 21 and defines the lower portion of the full-bore axial passage 23. The body members 21 and 26 are fluidly sealed in relation to one another, as at 27 and 28, to define an annular space in which an annular piston 29 is slidably disposed and sealingly engaged with the body members for dividing the annular space into enclosed upper and lower fluid chambers 30 and 31.

To control the fluid communication through the axial passage 23, the tester valve 10 further includes a movable valve such as a spherical ball member 32 (FIG. 2A) that is movably disposed between opposed upper and lower annular valve seats 33 and 34 which are respectively mounted within the upper portion of the outer body 21 and on the upper end member 35 of the mandrel 22. As is typical, the ball member 32 is cooperatively arranged so that as the mandrel assembly 22 is selectively moved upwardly and downwardly relative to the body 21, the ball member will be rotated in relation to the annular valve seats 33 and 34 to shift a transverse flow passage 36 in the ball between its depicted non-aligned or passage-blocking position and an aligned or open position. Those skilled in the art will, of course, appreciate that there are various prior-art arrangements for accomplishing these movements of the ball member 32 that can be incorporated into the tester valve 10 of the present invention. Nevertheless, in the preferred embodiment of the tester valve 20, an operating arrangement is employed which is described in more detail in U.S. Pat. No. 4,576,234 which is also assigned to the assignee of the present application and incorporated by reference herein. Accordingly, in keeping with the disclosure of that patent, the the ball member 32 is pivotally supported between upstanding projections on a tubular member 37 that is slidably arranged on and coupled by a lug 38 to the upper end of the unique mandrel assembly 22; and, as fully described in that patent, the ball member is selectively rotated back and forth between its non-aligned and aligned operating positions in response to the upward and downward movements of the mandrel assembly in relation to the tool body 21. Hereagain, it must be understood that the present invention is independent of the particular arrangement that may be employed for rotating the ball member 32 between its operating positions in relation to the valve seats 33 and 34.

An elongated coil spring 40 is coaxially disposed in the annular space defined between the tool body 21 and the lower portion of the new and improved mandrel assembly 22 and arranged with its lower and upper ends cooperatively engaged with opposed shoulders 41 and 42 on the body and mandrel for normally urging the mandrel assembly upwardly its depicted elevated position as determined by the engagement of an enlarged portion 43 on the mandrel with a downwardly-facing body shoulder 44. In keeping with the disclosure of the McGill patent, the mandrel assembly 22 also includes a pressure-responsive piston actuator 45 (as best provided by a sealing member 46 on the enlarged mandrel portion 43) and the mandrel assembly is fluidly sealed in relation to the tool body 21 for defining enclosed pressure chambers 47 and 48 above and below the piston actuator. A longitudinal passage 49 is provided in the tool body 21 for intercommunicating the upper pressure chamber 30 with the lower pressure chamber 48 below the piston actuator 45 and a lateral port 50 is provided in the tool body for communicating the upper pressure chamber 47 above the piston actuator with the well bore fluids. In this manner, the pressures in these chambers 47 and 48 can be controlled as required for selectively shifting the mandrel assembly 22 back and forth in relation to the tool body 21 and thereby rotating the ball member 32 between its open and closed positions.

In keeping with the disclosure of the above-identified McGill patent, it will be appreciated that the upper isolated chamber 30 above the annular piston 29 functionally corresponds to the gas or nitrogen chamber at "62" in the McGill patent and that the lower isolated chamber 31 below this annular piston acts as a so-called "reference pressure" chamber in the tester valve 10 that is communicated with the well bore fluids by a passage 51 in the body 21 so that the pressure in this lower chamber will always correspond to the pressure of those fluids as long as that passage is not blocked. As described in the McGill patent, the piston 29 maintains the pressure of the nitrogen confined in the enclosed upper chamber 30 at the pressure level of the well bore fluids which are admitted by way of the longitudinal passage 51 into the lower chamber 31 until that passage has been permanently blocked for trapping a quantity of the pressured well bore fluids in the lower chamber. Although any one of several arrangements can be used to selectively close the passage 51 at the outset of a testing operation for trapping the fluids in the lower chamber 31 at whatever pressure those fluids may be when the passage is blocked, it is preferred to control fluid communication to that passage by selectively-operable means such as the pressure reference tool 17 (FIG. 1) described in the aforementioned copending application.

Hereagain, it must be understood that the tester valve 10 of the present invention is independent of the particular arrangement that may be employed for selectively closing the longitudinal passage 51 so as to trap well bore fluids in the lower chamber 31. As previously mentioned above, even if it is considered advisable to include a bypass valve (such as shown at 18 in FIG. 1) in the tool string, the operation of the new and improved tester valve 10 is completely independent of whatever type of bypass valve, if any, that might be employed. The only thing of importance is, of course, to simply have the capability of selectively trapping a quantity of well bore fluids in the lower chamber 31 whenever it is deemed advisable to establish a constant "reference pressure" in the gas-filled upper chamber 30 which will be applied to the underside of the piston actuator 45 as the tester valve 45 is thereafter operated.

Figure 2A:
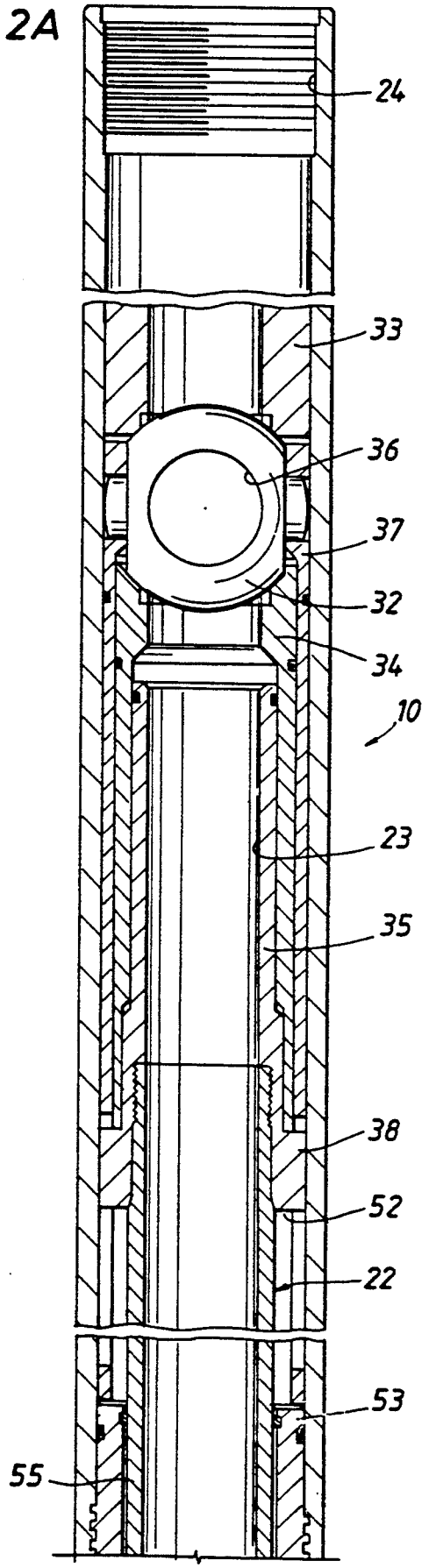

In any event, it must be realized that once the well bore fluids are trapped in the lower chamber 31 the pressure of the nitrogen in the upper chamber 30 is permanently communicated to the lower face of the actuating piston 45 by the longitudinal passage 49 in the tool body 21. On the other hand, the pressure of the well bore fluids is permanently communicated to the upper face of the piston 45 by the lateral port 50 in the external wall of the tool body 21. With this arrangement, in keeping with the teachings of the above-identified McGill patent, the ball member 32 can be rotated to its open position by raising the pressure of the well bore fluids to at least a selected first pressure level which is sufficient to shift the mandrel assembly 22 downwardly relative to the tool body 21 against the upwardly-directed forces collectively provided by the spring 40 and the pressure of the nitrogen in the reference pressure chamber 30. As best seen in FIG. 2A, it will be appreciated that the downward travel of the mandrel assembly 22 will continue until a shoulder 52 defined by the lower face of the lug 38 on the upper portion of the mandrel assembly 22 is abutted with an upwardly-facing shoulder 53 that is defined in the upper portion of the tool body 21. Conversely, the ball member 32 can be selectively rotated back to its closed position by simply reducing the pressure of the well bore fluids below that first pressure level until the combined biasing force provided by the spring 40 and the pressure force provided by the gas in the upper chamber 30 are sufficient to return the mandrel assembly 22 back to its elevated position in the body 21 which, as previously explained with respect to FIG. 2C, is determined by the engagement of the enlarged mandrel portion 43 with the body shoulder 44.

At this point it should be recognized that whenever the mandrel assembly 22 moves downwardly in relation to the tool body 21, the piston actuator 45 will compress the gas trapped in the upper chamber 30 to a higher pressure above the above-mentioned reference pressure. This will, of course, increase the pressure force which is effective for returning the mandrel assembly 22 to its elevated position. Nevertheless, those skilled in the art will appreciate that it is important to minimize the distance that the mandrel assembly 22 travels downwardly relative to the tool body 21 so that the pressure of the well bore fluids will not have to be increased any more than is necessary to operate the testing tool 12. Accordingly, in keeping with the objects of the present invention, the new and improved tester valve 10 is arranged to minimize the longitudinal spacing between the opposed shoulders 52 and 53 as much as possible.

It will, of course, be appreciated that in a typical drillstem testing operation utilizing the tester valve 10 of the present invention, the ball valve 32 will be repeatedly opened and closed during the course of that operation by successively increasing and decreasing the well bore pressure. Thus, for the most part, it is essential that the ball valve 32 be operatively coupled to the piston actuator 45. On the other hand, it will be realized by those skilled in the art that, at times, it can be advantageous to temporarily secure the ball valve 32 in its open position without having to maintain the well bore pressure at an elevated pressure level.

Figure 2B:
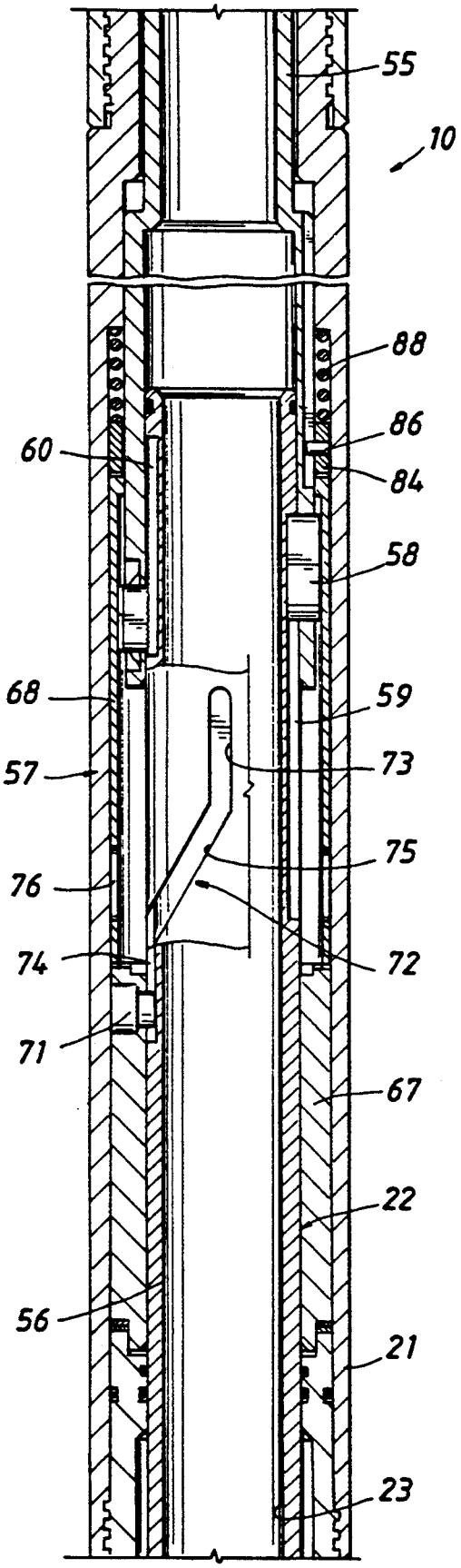
Figure 2C:
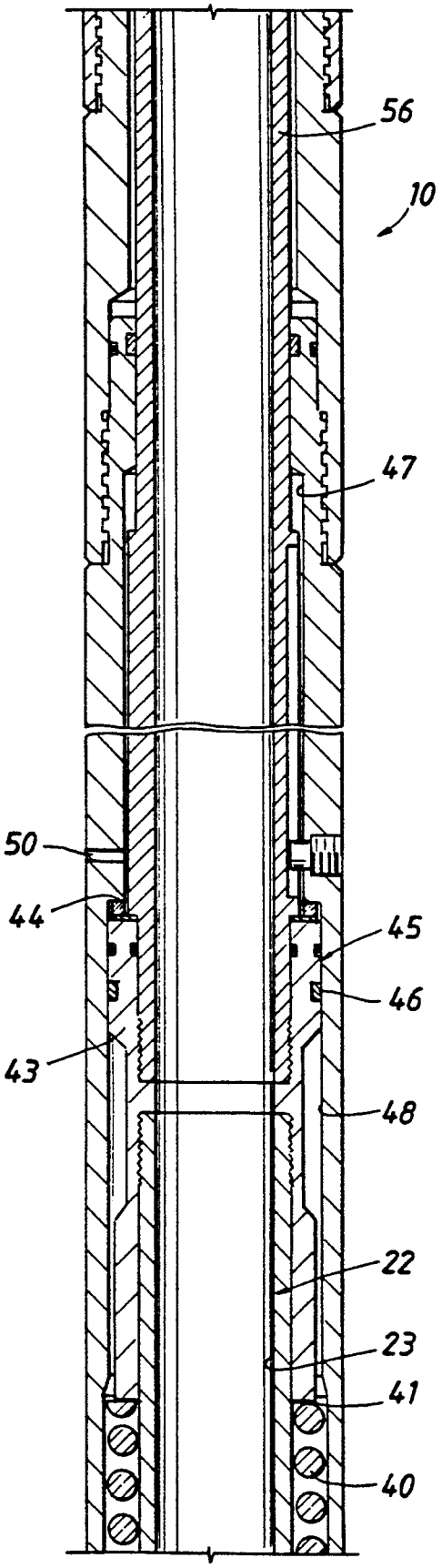

Accordingly, as best seen in FIGS. 2B and 2C, it will be appreciated that instead of being a typical unitary mandrel, the new and improved mandrel assembly 22 is instead comprised of upper and lower elongated tubular members 55 and 56 which are normally intercoupled to one another by selectively-releasable coupling means such as a unique clutch mechanism 57. As shown in FIG. 2A the lower valve seat 34 and the upper end member 35 are arranged on the upper end of the upper mandrel member 55; and it will be seen from FIG. 2C that the enlarged mandrel portion 43 and the seal 46 collectively representing the piston actuator 45 are arranged on the mid-portion of the lower mandrel member 56.

From FIG. 2B it will be seen that the lower end portion of the upper mandrel member 55 is appropriately sized for telescopically receiving the upper end portion of the lower mandrel member 56. To couple the mandrel members 55 and 56 to one another, means are provided such as an inwardly-directed lug 58 on the upper mandrel member that is slidably disposed within an elongated longitudinal groove 59 on the uppermost end portion of the lower mandrel member to provide a lost-motion connection between the mandrel members. It should be noted that whenever the tester valve 10 is in its depicted position with the valve member 32 in its normal passage-closing position, the upper edge of the elongated groove 59 is engaged on the upper edge of the lug 58. Accordingly, when the well bore pressure is increased to shift the lower mandrel member 56 downwardly, the coengagement of the upper edge of the groove 59 on the lug 58 will be immediately effective for pulling the upper mandrel member 55 downwardly and simultaneously rotating the ball valve member 32 to its passage-opening position.

Those skilled in the art will appreciate, however, that even though an increase in the well bore pressure will shift the mandrel members 55 and 56 downwardly to open the ball valve 32, because of the lost-motion connection provided by the lug 58 and the groove 59, a subsequent reduction of that pressure will not be effective for rotating the ball valve member 32 back to its passage-closing position. Instead, the upwardly-acting forces provided by the spring 40 and the pressured nitrogen in the chamber 48 will restore the lower mandrel 56 to its depicted elevated position without returning the upper mandrel 55 to its elevated position. Accordingly, to provide an upwardly-directed force on the upper mandrel 55 whenever the lower mandrel 56 is restored to its elevated position, the telescoped end portions of the two mandrels are releasably interconnected to one another by means such as an elongated coupling member 60 that is mounted in an upright position in an elongated groove 61 on the upper end of the lower mandrel and faced outwardly for cooperatively engaging an inwardly-facing matched lug 62 that is loosely mounted within a slot 63 in the lower end of the upper mandrel.

As shown in the drawings, the elongated coupling member 60 is provided with spaced teeth which, as shown generally at 64, are cooperatively engaged with complemental teeth on the inward face of the matched lug 62. In the preferred manner of arranging the teeth 64, the teeth are arranged on the member 60 so as to have their upper faces perpendicular to the lower mandrel 56 and their lower faces inclined downwardly while the teeth on the lug 62 are arranged in the reverse manner with their lower faces being perpendicular to the mandrel and their upper faces being inclined downwardly. In this manner, those skilled in the art will realize that whenever the mandrel 56 is shifted upwardly in response to a reduced well bore pressure, the transverse upper faces of the teeth on the elongated member 60 will engage the transverse lower faces of the teeth on the lug 62 so that the coengaged teeth 64 will cooperate for releasably securing the lower mandrel to the upper mandrel 55 so as to rotate the valve member 32 back to its passage-closing position. Biasing means, such as a bow spring 65 mounted in the groove 61 behind the elongated coupling member 60 and a bow spring 66 engaged with the rear of the toothed lug 62, are cooperatively arranged on the two mandrel members 55 and 56 for urging the coupling member toward the lug with a moderate force which is sufficient to keep their respective teeth 64 coengaged as the mandrels move upwardly.

It will, of course, be recognized that means must be provided to selectively uncouple the two mandrel members 55 and 56. Accordingly, in the preferred embodiment of the tester valve 10, uncoupling of the mandrels 55 and 56 is accomplished by means such as a first sleeve 67 that is coaxially mounted around the upper end of the lower mandrel 56 and a second sleeve 68 that is stacked on top of the first sleeve and coaxially mounted around the lower end of the upper mandrel 55. The inner wall of the body 21 is recessed, as at 69, for receiving the stacked sleeves 67 and 68 and defining an upwardly-facing shoulder 70 on which the lower sleeve is rotatably mounted. An inwardly-projecting lug 71 on the first sleeve 67 is loosely disposed in a somewhat Z-shaped groove 72 arranged on the adjacent external surface of the upper end of the lower mandrel 56. As seen in FIG. 2B, the Z-shaped groove 72 is arranged to define an upper groove portion 73 that is parallel to the central axis of the mandrel 56 and a lower groove portion 74 that is also parallel to that axis but angularly displaced in relation to the upper groove portion. An inclined groove portion 75 is arranged to interconnect the upper and lower groove portions 73 and 74. Accordingly, as the lower mandrel 56 is moved upwardly and downwardly in relation to the tool body 21, as the lug 71 is correspondingly moved upwardly and downwardly in the Z-shaped groove 72 the coaction of the lug 71 with the groove walls will cooperate for alternately turning the lower sleeve 67 back and forth in relation to the tool body 21 between the two angular positions respectively defined by the two groove portions 73 and 74. The significance of this alternate turning or rocking motion which is imparted to the lower sleeve 67 will subsequently become apparent.

Figure 4:
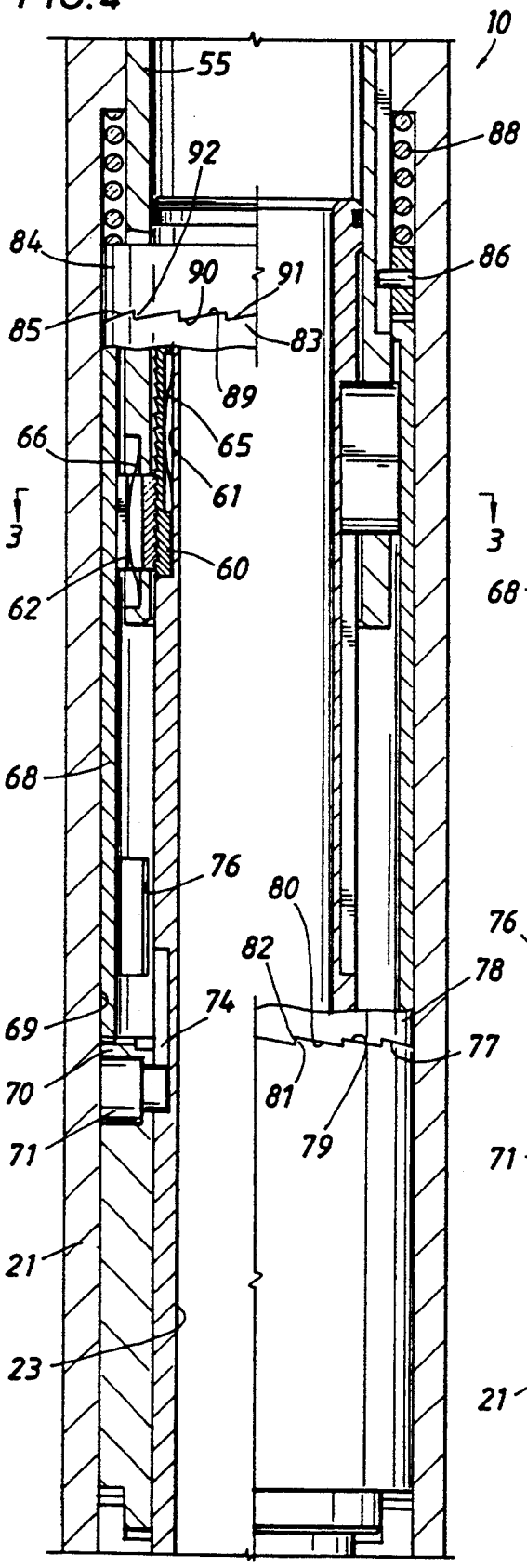
FIGS. 4 and 5 are detailed views which respectively illustrate significant aspects of the new and improved tester valve of the invention.
Figure 5:
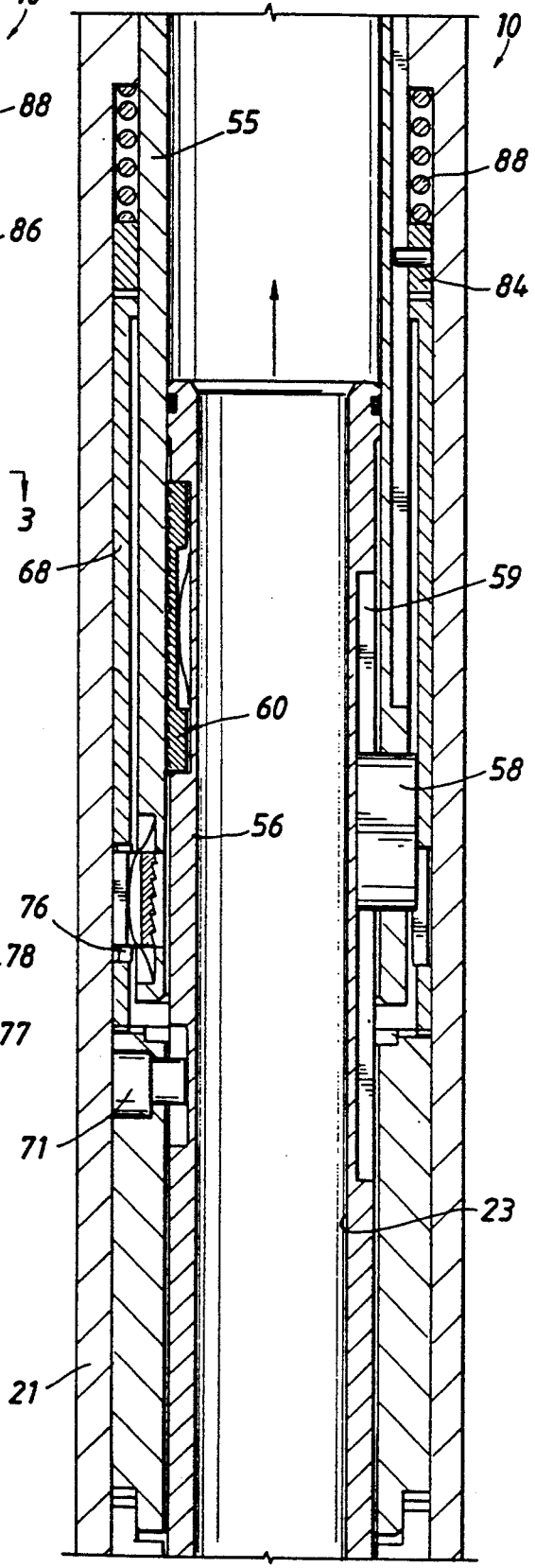

The upper sleeve 68 is cooperatively mounted within the recess 69 so as to be free to rotate. As illustrated in FIG. 4, a lateral opening or window 76 is cut in the lower portion of the second sleeve 68 and appropriately sized to permit the lug 62 to be easily moved into the window whenever the window and the lug are aligned with one another. From FIG. 4, it will be realized that so long as the mandrels 55 and 56 are respectively located in their elevated positions in relation to the tool body 21, the toothed lug 62 will be above the window 76. On the other hand, it will be seen from FIG. 5 that when the two mandrels 55 and 56 are respectively located in their telescoped positions relative to the tool body 21, the toothed lug 62 will be at the same level or transverse plane as the window 76. Thus, if the sleeve 68 can be rotated to bring the window 76 into alignment with the lug 62, the outwardly-directed biasing force of the bow spring 66 will be effective for pushing the toothed lug into the window so as to disengage the teeth 64. It will be appreciated, of course, that once the teeth 64 are disengaged, the lost-motion connection between the mandrels 55 and 56 will allow the lower mandrel to move upwardly in relation to the tool body 21 without shifting the upper mandrel upwardly at the same time. This will allow the lower mandrel 56 to move upwardly without returning the ball 32 to its passage-blocking position. Thus, once the toothed lug 62 is confined within the window 76, a reduction of the well bore pressure will allow the lower mandrel 56 to return to its elevated position without closing the ball member 32. As will be subsequently explained in more detail, this will enable the ball member 32 to be temporarily left open so that the full-bore axial passage 23 will be entirely free of obstruction without having to maintain an increased pressure in the well bore 13 as is normally the case during the operating cycle of the tester valve 10.

It will be seen, therefore, that the upper sleeve 68 must be rotated to a predetermined angular position and that the upper mandrel must be shifted to its telescoped position whenever it is desired to selectively uncouple the two mandrels 55 and 56. Accordingly, to accomplish this, a set of upwardly-directed teeth 77 are provided on the upper end of the lower sleeve 67 which are cooperatively coengaged with a complemental set of downwardly-directed teeth 78 on the lower end of the upper sleeve 68. As best seen in FIG. 4, these teeth 77 and 78 are respectively arranged to define inclined edge surfaces, as at 79 and 80, as well as vertical end surfaces as at 81 and 82. The preferred angular spacing between the successive vertical end surfaces 81 and 82 of the teeth 77 and 78 is arranged to equal the angular spacing between the end portions 73 and 74 of the Z-shaped groove 72. Thus, each time the mandrel 56 is shifted downwardly, as the inclined groove portion 75 is moved along the upper edge of the inwardly-directed lug 71 the lower sleeve 67 will be angularly displaced and, by virtue of the coengagement between the opposed end surfaces 81 and 82 of the teeth 77 and 78, the upper sleeve 68 will be incrementally turned or advanced by the same amount of angular displacement.

The return of the mandrels 55 and 56 to their elevated positions will, of course, carry the Z-shaped groove 72 upwardly in relation to the lug 71. Thus, as the lug 71 again enters the inclined groove portion 75, the upper sleeve 68 would usually be returned to its initial angular position unless retrograde travel of this upper sleeve is blocked. Accordingly, to prevent this retrograde movement of the upper sleeve 68, the upper end of the upper sleeve 68 is provided with a set of upstanding teeth 83 that are faced in the opposite direction from the teeth 78 and a ring 84 that has a set of complemental teeth 85 spaced around its lower end is slidably mounted in the upper end of the recess 69. To prevent the ring 84 from turning in relation to the body 21, an inwardly-projecting lug 86 is mounted on the ring and slidably disposed in an elongated longitudinal groove 87 defined in the adjacent external surface of the upper mandrel 55. Biasing means such as a spring 88 are provided for normally urging the ring 84 downwardly in relation to the body 21 so as to maintain the teeth 83 and 85 yieldably coengaged. It will, of course, be recognized that whenever the upper sleeve 68 is rotated so as to slide the inclined surfaces 89 on the teeth 83 across the inclined surfaces 90 on the teeth 85, the rotation of the upper sleeve will cause the ring 84 to be momentarily lifted in relation to the tool body 21. Then, once the ring 84 is sufficiently angularly advanced, the spring 88 will cooperatively urge the ring downwardly so that the vertical surfaces 91 on the teeth 83 will be coengaged with the vertical surfaces 92 on the teeth 85 and thereby prevent any retrograde movement of the upper sleeve 68.

From the foregoing description of the various actions of the several elements of the new and improved clutch mechanism 57 of the present invention, it will be seen that every time the mandrel assembly 22 is moved downwardly in relation to the body 21, the upper sleeve 68 will be incrementally advanced through an arc corresponding to the angular spacings of the teeth 77 and 78. On the other hand, every time the mandrel assembly 22 is returned upwardly to its illustrated elevated position, the coaction of the vertical surfaces 91 and 92 on the teeth 83 and 85 will keep the upper sleeve 68 in its incremental position and allow the lower sleeve 67 to be rotated back to its illustrated angular position. It will, of course, be appreciated that as the lower sleeve is returned to its initial angular position, the inclined surfaces 79 and 80 on the teeth 77 and 78 will temporarily lift the lower and upper sleeves 67 and 68 against the downwardly-acting biasing force of the spring 88. Nevertheless, once the upper sleeve 68 has been incrementally indexed to its subsequent angular position in relation to the body 21, the biasing force of the spring 88 will ensure that the upper sleeve will not be moved in the reverse direction. It should be noted at this point that in order for the teeth 83 and 85 to prevent retrograde movement of the upper sleeve 68, the number and the angular spacing of the teeth 78 and 83 on the opposite ends of the sleeve 68 must be the same and the vertical surfaces 82 and 91 on these teeth must be facing in the same direction.

Referring again to FIGS. 2A–2D, as described in the above-identified copending application and McGill patent, it will be appreciated that the mandrel assembly 22 will remain in its illustrated elevated position until the passage 51 is permanently closed. Once this occurs, well bore fluids that had previously entered the passage 51 will then be permanently trapped in the chamber 31 to provide a so-called "reference pressure" equal to the well bore pressure that existed at the time that the passage is blocked. This "reference pressure" will also be trapped in the lower portion of the gas-filled chambers 30 and 48 by way of the intercommunication of the passage 49. Thereafter, the new and improved pressure-operated tester valve 10 is operated by successively increasing and relieving the well bore pressure.

As previously mentioned, a typical drillstem testing operation is conducted by successively opening and closing the valve member such as the ball valve 32 in the tester valve 10. Those skilled in the art will, of course, appreciate that there is no fixed standard as to how many times the ball valve 32 must be opened and closed during any given testing operation. It will be recognized, therefore, that the only thing that can be safely predicted is that ordinarily the tester valve 10 must be opened and closed more than once during any given testing operation and that, from time to time, it is advantageous to leave the valve member 32 open while another completion operation is carried out without having to maintain the well bore pressure at an elevated level.

Accordingly, in arranging the clutch mechanism 57, it will be recognized that the optimum arrangement is to arrange the tester valve 10 with an operating cycle where the ball valve 32 will be successively opened and closed a selected number of times such as, for example, six times before the ball valve member is releasably retained in its open position. This can, of course, be carried out by arranging the clutch mechanism 57 to have six teeth for each set of teeth 77 and 78. The elongated slots 73 and 74 would be angularly displaced by sixty degrees. With this arrangement the lower sleeve 67 will be advanced through an arc of sixty degrees every time the mandrel assembly 22 is shifted downwardly in relation to the body 21 and thereby simultaneously advance the upper sleeve 68 through a corresponding arc from its initial angular position to its second angular position. Then, when the mandrel assembly 22 is moved upwardly, the lower sleeve 67 will be returned to its initial angular position as the slot 75 is again moved along the lug 71. Nevertheless, by virtue of the coengaged vertical surfaces 91 and 92 on the teeth 83 and 85, the upper sleeve 68 will be retained against retrograde movement from its second angular position.

Thus, as the mandrel assembly 22 is successively raised and lowered in response to a series of sequential increases and decreases of the well bore pressure, the upper sleeve 68 will be progressively advanced in the same rotational direction until such time that the window 76 in the lower portion of the upper sleeve will be moved directly below the toothed lug 62 the next time that the mandrel assembly is moved downwardly. When this takes place, the toothed lug 62 will be carried downwardly as the upper sleeve 68 is simultaneously rotated to bring the window 76 alignment with the toothed lug 62. Once this takes place, the biasing force of the bow spring 66 will urge the toothed lug 62 outwardly into the window 76 and disengage the teeth 64. This, of course, will free the lower mandrel 56 to move independently of the upper mandrel 55 to its elevated position whenever the well bore pressure is reduced. It will be appreciated that once it is uncoupled from the lower mandrel 56, there will be few if any unbalanced forces acting on the upper mandrel 55 and it will, therefore, remain in its telescoped position for temporarily retaining the valve member 32 in its passage-opening position.

Once the toothed lug 62 has been pushed into the window 76 it will be appreciated that on the next downward stroke of the lower mandrel 56 in response to a subsequent increase in the well bore pressure, the coaction of the lug 71 and the inclined slot 75 will again turn the lower sleeve 67 so as to carry the window 76 out of alignment with the toothed lug 62 as the upper sleeve 68 is advanced to its next incremental angular position relative to the body 21. Thus, the mandrel assembly 22 must be shifted upwardly and downwardly a sufficient number of times to return the window 76 to an angular position where the next downward movement of the mandrel assembly 22 will again carry the toothed lug 62 into alignment with the window. Once this occurs, as the upper sleeve 68 is turned, the tapered longitudinal edge of the window that is behind the trailing side edge of the toothed lug will move underneath the back of the lug 62 sufficiently to push lug out of the window 76. The upper and lower mandrels 55 and 56 will again be coupled together so that the valve member 32 will now be closed the next time that the mandrel assembly 22 is moved upwardly to its elevated position. This will, of course, begin a new operating cycle where the mandrel assembly 22 will again move upwardly and downwardly for a given number of strokes before the upper and lower mandrels 55 and 56 are subsequently uncoupled and leave the valve member 32 open.

It will be appreciated that with only a single window, as at 76, the upper sleeve 68 must be advanced through a complete circle or revolution before the toothed lug 62 is again coengaged with the elongated coupling member 60. Thus, if it is considered advisable to reduce the number of times that the mandrel assembly 22 must be moved upwardly and downwardly in a given cycle, it is within the scope of the present invention to have a second window (not illustrated) on the opposite side of the upper sleeve 68 from the window 76. It is also within the scope of the present invention to provide alternate sets of sleeves similar to the sleeves 67 and 68 but with various arrangements of coacting teeth and windows.

Accordingly, it will be appreciated that the present invention has provided a selectively-operable full-bore tester valve for conducting drillstem testing operations as well as one or more completion operations where the tester valve can be left open without having to take special measures to keep the valve open before continuing with a second series of drillstem testing operations. By arranging the tester valve to be operated by a unique mandrel assembly comprised of upper and lower mandrel sections that are releasably coupled together by a selectively-releasable clutch mechanism, the tester valve can be operated by successively raising and lowering the mandrel assembly for a predetermined number of operating cycles. Once the first series of operating cycles have been concluded, the clutch mechanism cooperates to uncouple the mandrel sections so that the valve member will be left in its passage-opening position to provide access through the mandrel sections to the well bore below the tester valve. Thereafter, the mandrel sections are moved to operate the clutch mechanism for recoupling the mandrel sections so that the valve member can be reclosed.

While a particular embodiment of the present invention has been shown and described, it is apparent that changes and modifications can be made without departing from this invention in its broader aspects; and, therefore, the aim in the appended claims is to cover all such changes and modifications as may fall within the true spirit and scope of this invention.

What is claimed is:

1. A well tool for positioning in a well bore to control the flow of fluids between the well bore and a pipe string and comprising:

a tool body having an axial passage and arranged for coupling in a pipe string;

valve means including a valve member movable between open and closed operating positions for controlling communication through said axial passage;

valve-actuating means operable for moving said valve member to one of its said operating positions in response to increases of the well bore pressure to at least a predetermined pressure level and operable for moving said valve member to the other of its said operating positions in response to decreases of the well bore pressure below said predetermined pressure level, said valve-actuating means including an actuating mandrel movable between spaced longitudinal positions in said tool body for shifting said valve member to its said operating positions; and coupling means arranged for selectively uncoupling said valve means from said valve-actuating means only after a predetermined number of alternate increases and decreases of the well bore pressure in relation to said predetermined pressure level, said coupling means being arranged to uncouple said actuating mandrel from said valve means only when said actuating mandrel is between its said spaced positions.

2. The well tool of claim 1 wherein said coupling means are arranged to uncouple said valve means from said valve-actuating means only when said valve member is moved to one of its said operating positions.

3. The well tool of claim 1 wherein said coupling means are operable for uncoupling said valve-actuating means from said valve means only when said valve member is in its said open position.

4. The well tool of claim 1 wherein said actuating mandrel is movable back and forth between spaced positions for successively shifting said valve member between its said open and closed positions; and said coupling means are operable for uncoupling said actuating mandrel from said valve means only when said actuating mandrel is being moved between its said spaced positions.

5. The well tool of claim 1 wherein said coupling means are operable for uncoupling said actuating mandrel from said valve means when said valve member is in one of its said operating positions so that said actuating mandrel will then be freed for subsequent movement between its said spaced positions without returning said valve member to its other operating position.

6. The wall tool of claim 5 wherein said coupling means are operable for subsequently recoupling said actuating mandrel to said valve means only after a predetermined number of subsequent increases and decreases of the wall bore pressure in relation to said predetermined pressure level.

7. The well tool of claim 1 wherein said coupling means are operable for uncoupling said actuating mandrel from said valve means only when said valve member is in its said open position so that said actuating mandrel is then free to travel between its said spaced positions without returning said valve member to its said closed position.

8. The well tool of claim 7 wherein said coupling means are further operable for subsequently coupling said actuating mandrel to said valve means again only after a predetermined number of subsequent increases and decreases of the well bore pressure in relation to said predetermined pressure level.

9. A well tool for controlling the flow of fluids between a well bore and a pipe string and comprising:

a tool body having an axial passage;

valve means including a valve member arranged in said axial passage for movement between open and closed positions;

pressure-responsive actuating means operatively arranged on said tool body for movement to one operating position for moving said valve member to one of its said positions upon an increase of well bore pressure to a predetermined level and for movement to another operating position for moving said valve member to the other of its said positions in response to a decrease of well bore pressure below said predetermined level, said actuating means including an actuating mandrel movable between spaced longitudinal positions in said tool body for shifting said valve member to its said open and closed positions; and coupling means selectively operable for coupling said valve means to said actuating means during a first predetermined cycle of alternate increases and decreases of well bore pressure and for thereafter selectively uncoupling said valve means from said actuating means during a second predetermined cycle of alternate increases and decreases of well bore pressure, said coupling means being arranged to uncouple said actuating mandrel from said valve means only when said actuating mandrel is between its said spaced longitudinal positions.

10. The well tool of claim 9 wherein said coupling means are operable for uncoupling said actuating means from said valve means only when said valve member is being moved to one of its said operating positions at the end of said first cycle.

11. The well tool of claim 9 wherein said coupling means are operable for uncoupling said actuating means from said valve means only when said valve member reaches its said open position at the end of said first cycle.

12. The well tool of claim 9 wherein said pressure-responsive actuating means include a piston actuator movable back and forth between longitudinally-spaced positions within said tool body and a valve actuator movable back and forth between longitudinally-spaced positions within said tool body and cooperatively arranged for moving said valve member back and forth between its said open and closed positions; and said coupling means are selectively operable for coupling said actuators to one another during said first cycle and uncoupling said actuators from one another at the end of said first cycle so that said piston actuator is then free to move between its said longitudinally-spaced positions without moving said valve actuator so that said valve member will remain in one of its positions during said second cycle.

13. The well tool of claim 12 wherein said one position of said valve member is its said open position.

14. The well tool of claim 12 wherein said coupling means are selectively operable for subsequently recoupling said actuators to one another at the end of said second cycle so that said valve member will thereafter be moved back and forth between its said open and closed positions in response to subsequent increases and decreases of the well bore pressure.

15. The well tool of claim 14 wherein said one position of said valve member is its said open position.

16. The well tool of claim 9 wherein said valve member is a ball having a transverse flow passage; and further including at least one annular valve seat coaxially arranged within said axial passage, means pivotally supporting said ball in relation to said coupling means for rotation relative to said tool body between its said open position where said transverse flow passage in said ball is aligned with said valve seat and its said closed position where said transverse flow passage in said ball is not aligned with said valve seat.

17. The well tool of claim 14 wherein said one position of said valve member is its said open position where said transverse flow passage in said ball is aligned with said valve seat.

18. The well tool of claim 9 wherein said pressure-responsive actuating means include an upper mandrel and a lower mandrel representing said actuating mandrel respectively arranged for moving independently of one another and between longitudinally-spaced upper and lower operating positions within said tool body, piston means cooperatively arranged on one of said mandrels for moving said one mandrel back and forth between only its said upper and lower operating positions in response to increases and decreases of well bore pressure, and valve actuator means cooperatively arranged on the other of said mandrels for moving said valve member back and forth between its said open and closed positions in response to movement of said other mandrel between its said upper and lower operating positions; and wherein said coupling means are operable for coupling said mandrels to one another for moving said valve member back and forth between its said open and closed positions during said first cycle and then uncoupling said mandrels from one another at the conclusion of said first cycle so that said one mandrel is thereafter free for moving between its said upper and lower operating positions without also moving said other mandrel so that said valve member will remain in one of its positions during said second cycle.

19. The well tool of claim 18 wherein said one position of said valve member is its said open position.

20. The well tool of claim 18 wherein said coupling means are operable for subsequently recoupling said mandrels to one another at the conclusion of said second cycle so that said valve member will be moved back and forth between its said open and closed positions as said one mandrel is thereafter moved between its said upper and lower operating positions.

21. The well tool of claim 20 wherein said one position of said valve member is its said open position.

22. A well tool for controlling the flow of fluids between a well bore and a pipe string and comprising:

a tool body having an axial passage;

a valve member arranged in said axial passage for movement between open and closed positions;

pressure-responsive actuating means including upper and lower mandrels arranged within said tool body for respectively moving independently of one another between spaced upper and lower positions, piston means on one of said mandrels for moving said one mandrel between its said spaced positions in response to increases and decreases of well bore pressure, and valve actuator means arranged on the other of said mandrels for moving the other mandrel between its said spaced positions and for shifting said valve member between its said open and closed positions as said other mandrel moves between its said spaced positions; and coupling means operable for coupling said mandrels together for moving said valve member between its said open and closed positions during a first cycle of successive increases and decreases of well bore pressure and for thereafter selectively uncoupling said mandrels from one another at the end of said first cycle so that said one mandrel is thereafter free for moving between its said spaced positions during a second cycle of successive increases and decreases of well bore pressure without also moving said other mandrel so that said valve member will remain in its said open position during said second cycle, said coupling means being arranged to uncouple said one mandrel from said other mandrel and from said valve member only when said one mandrel is between its said spaced positions.

23. The well tool of claim 22 wherein said cycles include a predetermined number of said successive increases and decreases.

24. The well tool of claim 22 wherein said cycles include a predetermined number of said successive increases and decreases in relation to a predetermined pressure level.

25. The well tool of claim 22 wherein said coupling means are further operable for subsequently recoupling said mandrels to one another at the end of said second cycle.

26. The well tool of claim 22 wherein the adjacent end portions of said upper and lower mandrels are telescoped together; and said coupling means include means defining an outwardly-facing transverse tooth on one side of the inner mandrel end portion, a toothed member arranged on one side of the outer mandrel end portions for moving inwardly and outwardly in relation thereto and having at least one inwardly-facing transverse tooth for coengaging said outwardly-facing tooth when said toothed member is longitudinally positioned and angularly oriented with said inwardly-facing tooth opposing said outwardly-facing tooth for transferring longitudinal movements of said one mandrel to said other mandrel, a sleeve coaxially disposed around said outer mandrel and said toothed member and having an inner wall arranged for keeping said teeth coengaged with one another, means defining an opening in said wall to receive said toothed member, biasing means operable for moving said toothed member into said opening for disengaging said teeth whenever said sleeve is longitudinally positioned and angularly oriented to align said opening with said toothed member, and indexing means cooperatively arranged between said tool body and said sleeve for turning said sleeve relative to said outer mandrel in response to movements of said mandrels between their upper and lower positions during said first cycle and then aligning said opening with said toothed member at the conclusion of said first cycle to allow said biasing means to move said toothed member outwardly into said opening to disengage said teeth in order that said one mandrel will thereafter be free for moving between its said spaced positions during said second cycle.

27. The well tool of claim 26 wherein said indexing means are further operable for turning said sleeve in response to movements of said one mandrel during said second cycle to realign said toothed member with said outwardly-facing tooth and move said toothed member back into engagement therewith for subsequently recoupling said mandrels to one another at the end of said second cycle so that further movements of said one mandrel between its said spaced positions will again move said valve member between its open and closed positions.

28. The well tool of claim 22 wherein said valve member is a ball having a transverse flow passage; and further including at least one annular valve seat coaxially arranged within said axial passage, means pivotally supporting said ball on said end portion of said other mandrel for rotation relative thereto between its said open position where said transverse flow passage is aligned with said valve seat and its said closed position where said transverse flow passage is out of alignment with said valve seat.

* * * * *